US005509613A

United States Patent [19]

Page

[11] Patent Number: 5,509,613

[45] **Date of Patent: *Apr. 23, 1996**

[54] MATERIALS GRINDER

[75] Inventor: James H. Page, Bottineau, N. Dak.

[73] Assignee: Rexworks, Inc., Milwaukee, Wis.

[ * ] Notice: The portion of the term of this patent shall not extend beyond the expiration date of Pat. No. 5,344,088.

[21] Appl. No.: 178,679

[22] Filed: Jan. 7, 1994

Related U.S. Application Data

[63] Continuation of Ser. No. 778,322, Nov. 17, 1991, Pat. No. 5,344,088.

[51] Int. Cl.[6] ..... B02C 1/08

[52] U.S. Cl. ..... 241/282; 241/287

[58] Field of Search ..... 241/73, 282, 287

[56] References Cited

U.S. PATENT DOCUMENTS 3,160,351 12/1964 Shelton ..... 241/282 X 3,690,572 9/1972 Thurara et al. ..... 241/282 X

*Primary Examiner*—Douglas D. Watts

*Attorney, Agent, or Firm*—Reinhart, Boerner, Van Deuren, Norris & Rieselbach

[57] ABSTRACT

A materials grinder has a materials receiving hopper, an exit opening into a shrouded grinding chamber and a powered ram for driving materials accumulated in the hopper to and through the exit into the grinding chamber. As grinding drum is rotatably disposed inside of a shroud adjacent the exit of the hopper to grind the ends of materials to be ground as they enter the grinding chamber and to continue to grinding as the materials are carried downwardly toward the bottom rear of the grinding chamber. The bottom of the shroud is open to receive an adjustable transverse shear bar assembly that is pivotally mounted to provide adjustment of the upper edges of the transverse shear bars with respect to the materials grinder drum.

9 Claims, 7 Drawing Sheets

MATERIALS GRINDER

CROSS REFERENCES TO RELATED APPLICATIONS

This is a continuation of U.S. patent application Ser. No. 07/778,322 filed Nov. 17, 1991, now U.S. Pat. No. 5,344,088. The subject matter of the present invention is related to the subject matter of co-pending U.S. patent applications entitled: ASPHALT GRINDER, Ser. No. 636,510, filed Dec. 31, 1990, in the name of Robert J. Page; and MATERIALS GRINDER, Ser. No. 632,505, filed Dec. 31, 1990, in the name of James H. Page.

BACKGROUND OF THE INVENTION

1. Field of the Invention

This invention relates generally to materials grinding apparatus and is more particularly directed to apparatus for recycling aggregate structures or simply materials to a predetermined size as might be desired by the operator of the apparatus and as required by the use to which the comminuted materials may be applied.

2. Description of the Prior Art

The aforementioned co-pending United States patent applications include listings of prior art also known to me and in addition I am aware of U.S. Pat. No. 4,736,781 issued Apr. 12, 1988 to Morey et al. for STUMP DISINTEGRATOR. While there may be examples amongst the prior art identified above, that seek to accomplish a similar result, it is my belief that no one, nor any reasonable combination, of the prior art patents specifically shows or suggests the novel and unobvious combination of elements as will be set forth in the specification and claimed in this application.

SUMMARY OF THE INVENTION

The present invention provides an improved materials grinding apparatus for reducing chunks of homogenous or aggregative materials or structures to substantially uniform, comminuted particulate material of a variable, predetermined size. My invention, in its simplest terms, is comprised of a hopper having a generally horizontally-disposed bottom for receiving materials to be ground, an exit opening at one end and a ram at an opposite end for controllably moving materials toward the exit opening. A grinding drum, having a surface which is substantially abrasive to the materials to be ground, is disposed adjacent the exit opening with its axle in substantial horizontal disposition and parallel to the plane of the exit opening in the hopper. Underneath and adjacent to the surface of the drum are a plurality of transversely extending breaker or shear bars to create a coaction between the materials introduced into the spaces between the peripheral surface of the drum and the shear bars to cause the materials to be reduced in size by the grinding action of the drum. The shear bars may be mounted on a concave which is mounted and disposed to be rotatable toward and away from the lower :peripheral surface of the grinding drum.

In one embodiment of my invention, the grinding drum is surrounded by a shroud which may include materials deflecting members which cause ground particles of an excessive size to be recirculated within and about the grinding drum. In a still further embodiment, a breaker bar member may be transposed transversely of the hopper above the exit opening to guide and exert a downward force on the materials being conveyed through the hopper by the action of the ram toward the exit opening.

In another embodiment of my invention, the rear lower periphery of the grinding drum is surrounded by a stationary or moveable screen member which may be used to control the ground particle size that may be discharged.

Other objects and advantages of my invention will be evident from the following detailed description when read in connection with the accompanying drawings which illustrate preferred embodiments of my invention.

DESCRIPTION OF THE ILLUSTRATED EMBODIMENT

Figure 1:
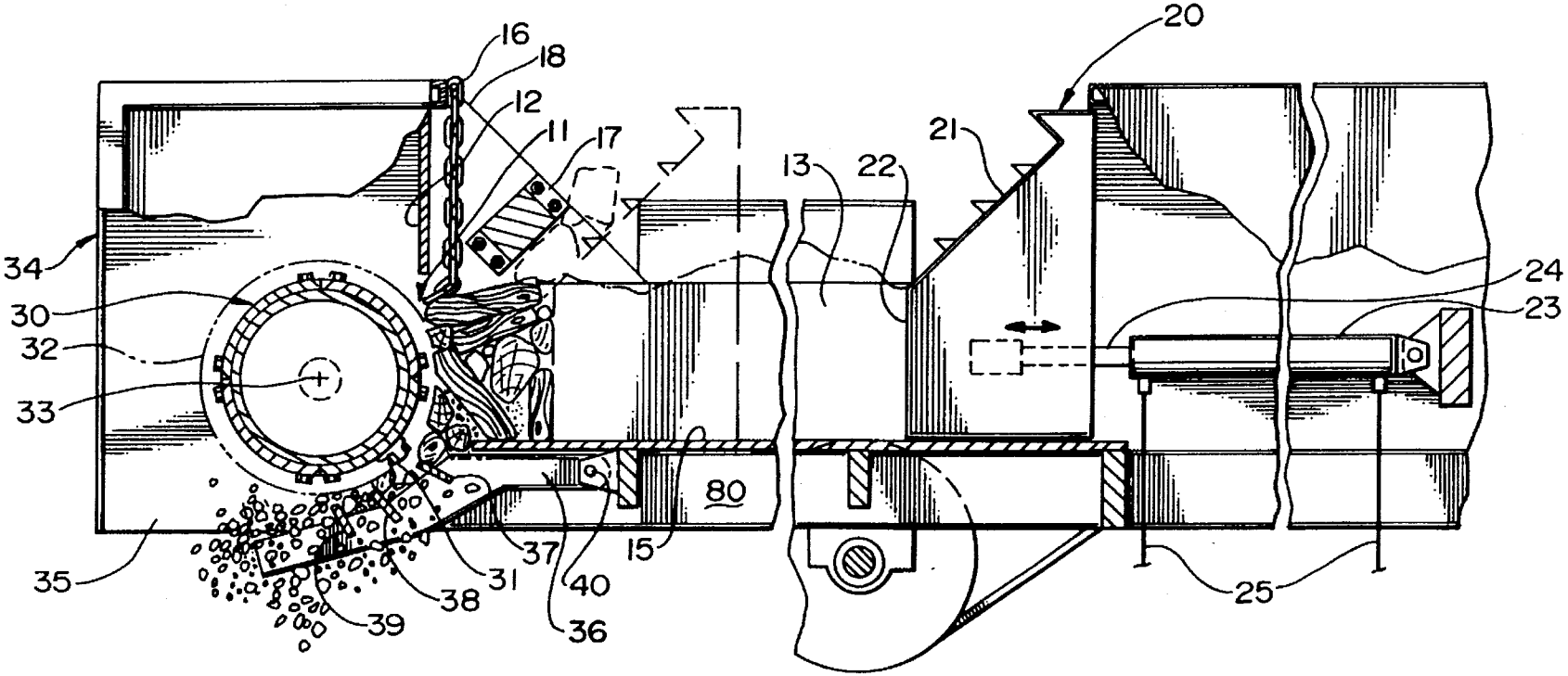
FIG. 1 is a fragmentary right side elevational view of the invention shown, in part, with parts broken away.

Referring now to the drawings, my materials grinder is shown comprised of a frame 80 upon which are mounted a hopper 10, a drum 30, and a power module 60.

The basic elements of my invention are illustrated as hopper 10 having an exit opening 11 extending transversely across the bottom of a front wall 12 that is disposed between side walls 13 and 14 and extends upwardly from the front end of bottom 15. A chain curtain 16 is hung from the top of front wall 12 and a breaker bar 17 extends intermediate gussets 18 at the top portions of side walls 13 and 14 transversely, adjacent to and above, exit opening 11. Bottom 15 is shown disposed and mounted upon suitable cross members (not identified with reference characters) of frame 80 so that it is rigidly supported. At the right end of hopper 10, arm 20 having a shape substantially that of a transverse cross section of hopper 10 is shown having an inclined top portion 21 and a generally vertically disposed bottom portion 22. Ram 20 is reciprocally disposed within hopper 10 and is operable between the position shown in FIG. 1 of the drawings and a position adjacent exit opening 11 on hopper 10 by suitably energizing cylinder 23 through hydraulic lines 25 to longitudinally displace piston 24 to convey the materials within hopper 10 toward exit opening 11.

A cylindrical abrading drum 30 is shown having its axis of rotation disposed transversely of exit opening 11 and generally parallel to front wall 12 and floor 15 on hopper 10. Drum 30 is provided with a plurality of abrading teeth 31 which combine to generate and provide an abrading surface 32.

Drum 30 is shown surrounded by a downwardly opening shroud 34 having an open bottom 35.

Figure 3:
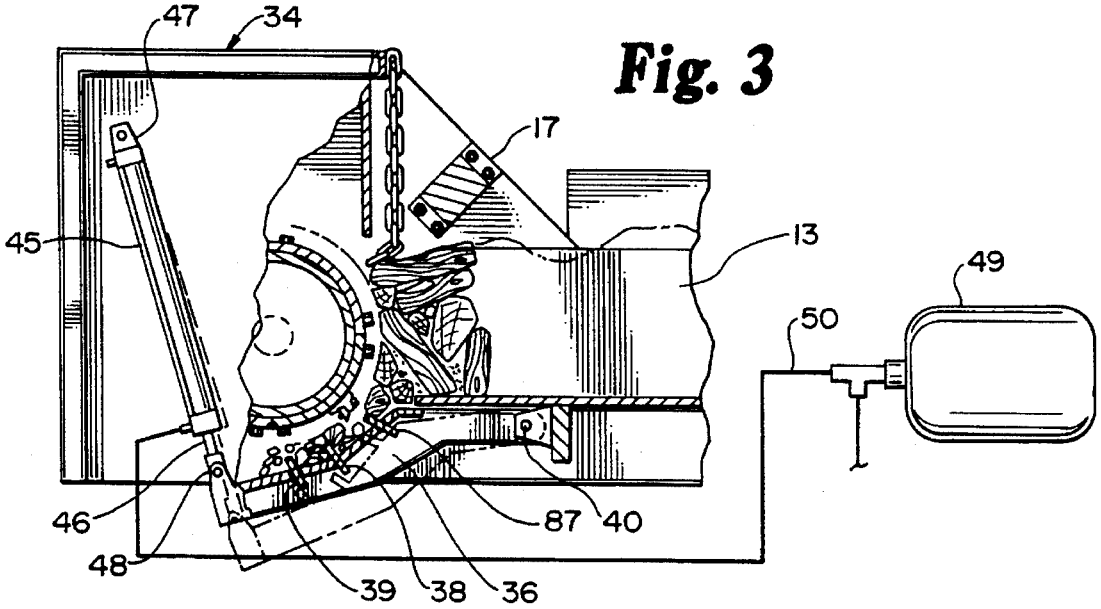
FIG. 3 is a fragmentary right side elevational view of the apparatus of FIG. 1 together with a simplified control therefore.

A concave 36, having a plurality of transversely-extending shear bars 37, 38, and 39, is shown pivotally attached at its right end by pivot 40 on base 80. 0n FIG. 3, a cylinder 45 has one end pivotally attached to a pivot member 47 on the inside of shroud 34 and the other end of piston 46 is attached to the end of concave 36 by pin 48. An accumulator 49 is connected to hydraulic line 50 to permit downward movement of the rear end of concave 36.

Figure 2:
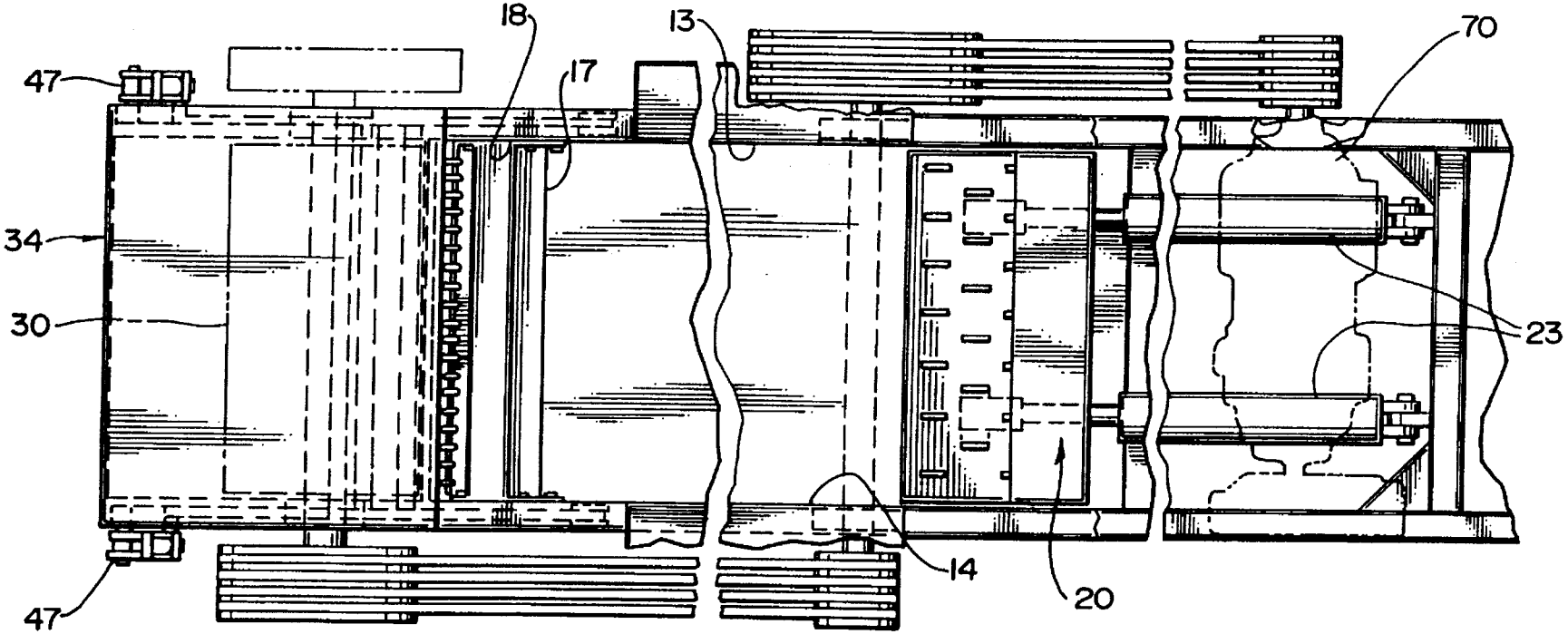
FIG. 2 is a top plan view of the illustration of FIG. 1.
Figure 2A:
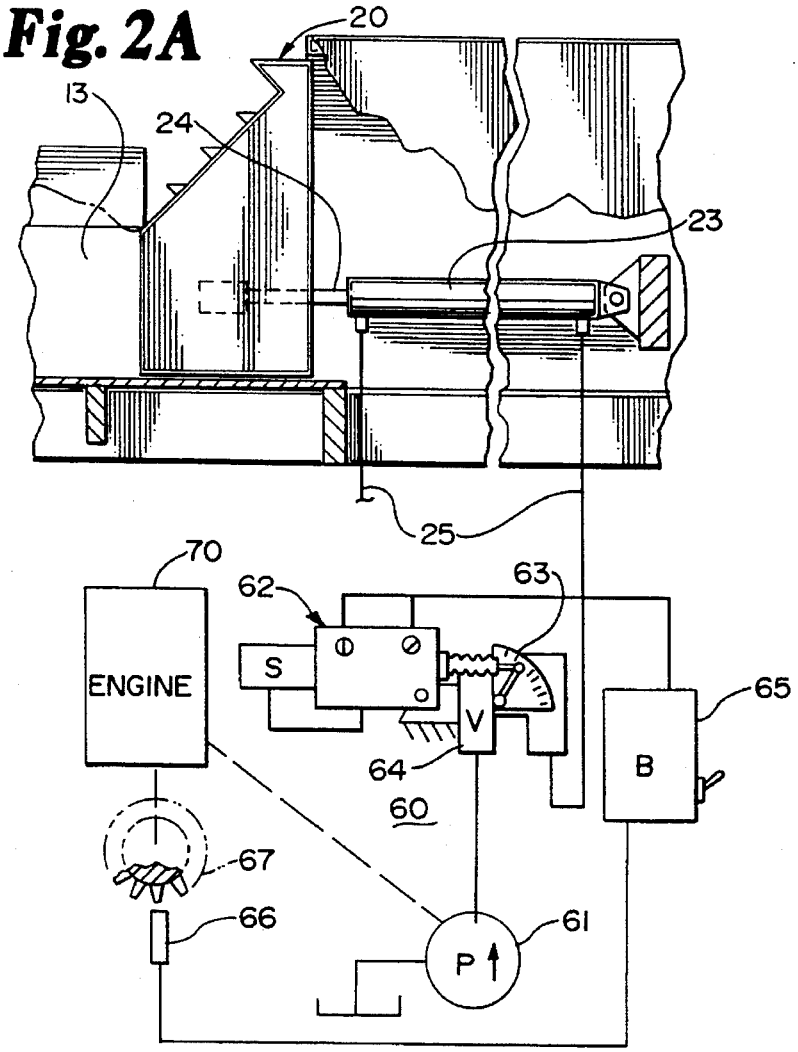
FIG. 2A is a simplified fragmentary diagram illustrating a control for the apparatus of FIG. 1.

In FIG. 2A, a power module 60 includes an engine 70 that is adapted to drive a suitable hydraulic pump 61 through suitable driving means. Hydraulic pump 61 is shown connected to a hydraulic valve 62 which is operable to drive a speed control consisting of a flow control valve 63 and a valve 64 for controlling the operation of ram 20 from a controller 65 that is shown connected to a speed sensor 66 adjacent an engine gear 67 and to controller 65.

Figure 4:
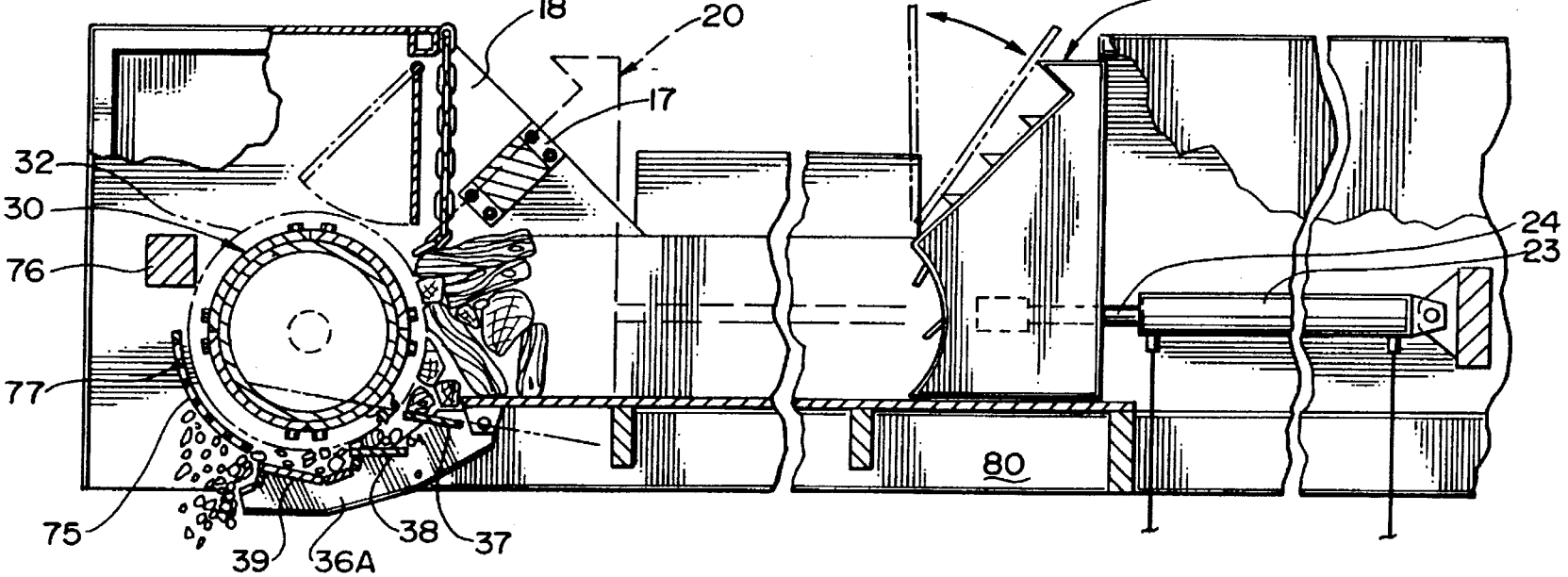
FIG. 4 is a fragmentary right side elevational view illustrating a further embodiment of my invention.
Figure 5:
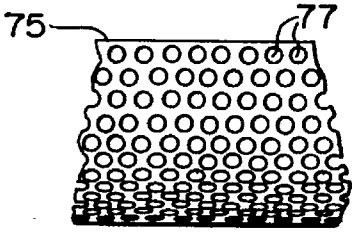
FIG. 5 is a fragmentary rear elevational view of a portion of FIG. 4.

In the embodiment of FIG. 3, concave 36 is shown having a closed "floor" comprised of suitable structural members extending transversely across concave 36 and between breaker bars 37, 38 and 39. This prevents an early discharge of the ground particulate material and serves to maintain the larger particles for further grinding before discharge at the rear end of concave 36. In FIG. 4, modified concave 36A is shown configured generally as concave 36 on FIG. 3 and a further particulate grading screen 75, having a plurality of suitably sized perforations is disposed to extend transversely of shroud 34 adjacent to the lower rear surface of drum 30 and a further breaker bar 76 is disposed transversely across shroud 34 at a position substantially adjacent to the affective surface 32 of drum 30 so that larger particulate may be carried upwardly and first being encountered by breaker bar 76 for further abrasion and then carried upwardly and around the top of drum 30 to reenter the grinding cycle that is initiated at the forward front surface of drum 30.

Figure 7:
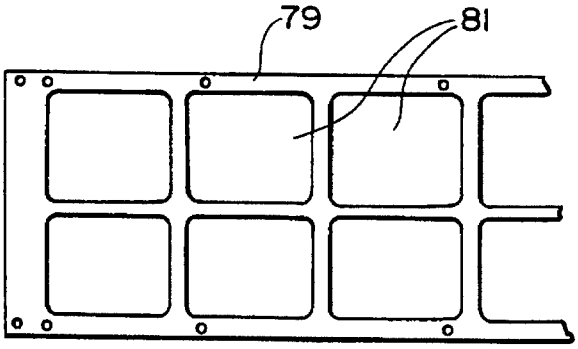
FIG. 7 is a partial plan view of one of the elements of the embodiment of FIG. 6.
Figure 6:
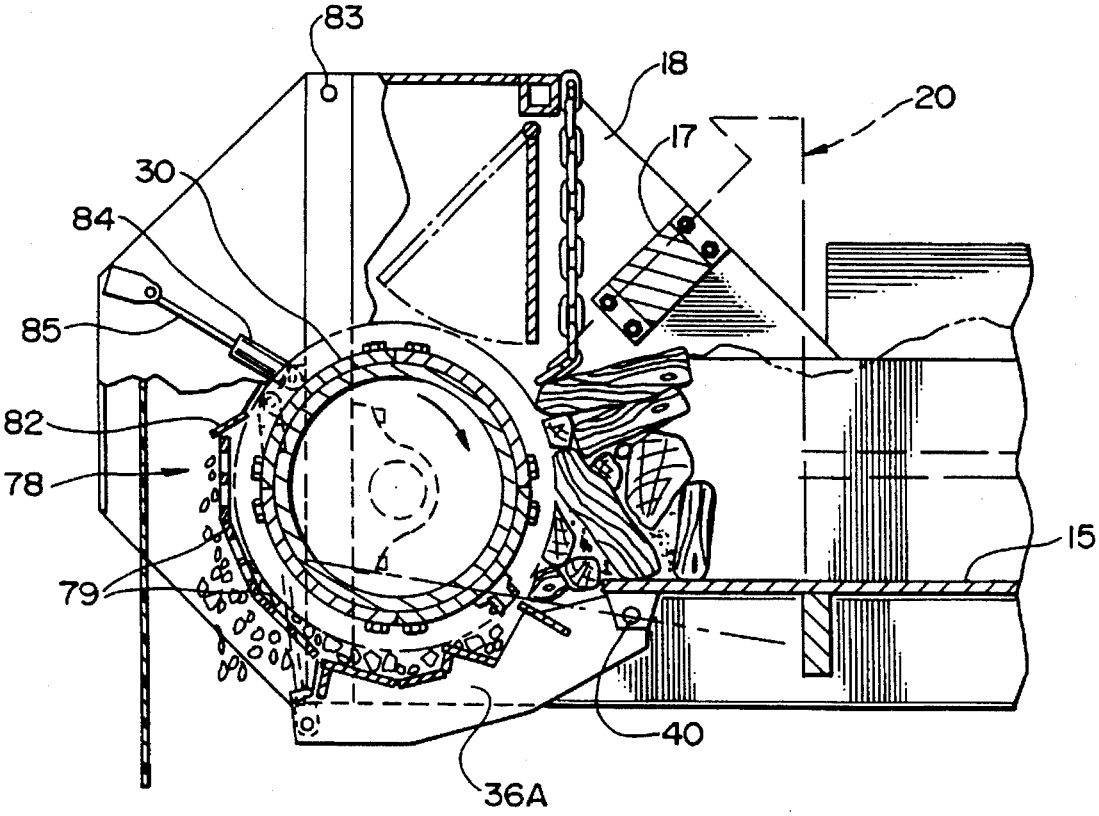
FIG. 6 is a fragmentary right side elevational view of a further embodiment of my invention.
Figure 8:
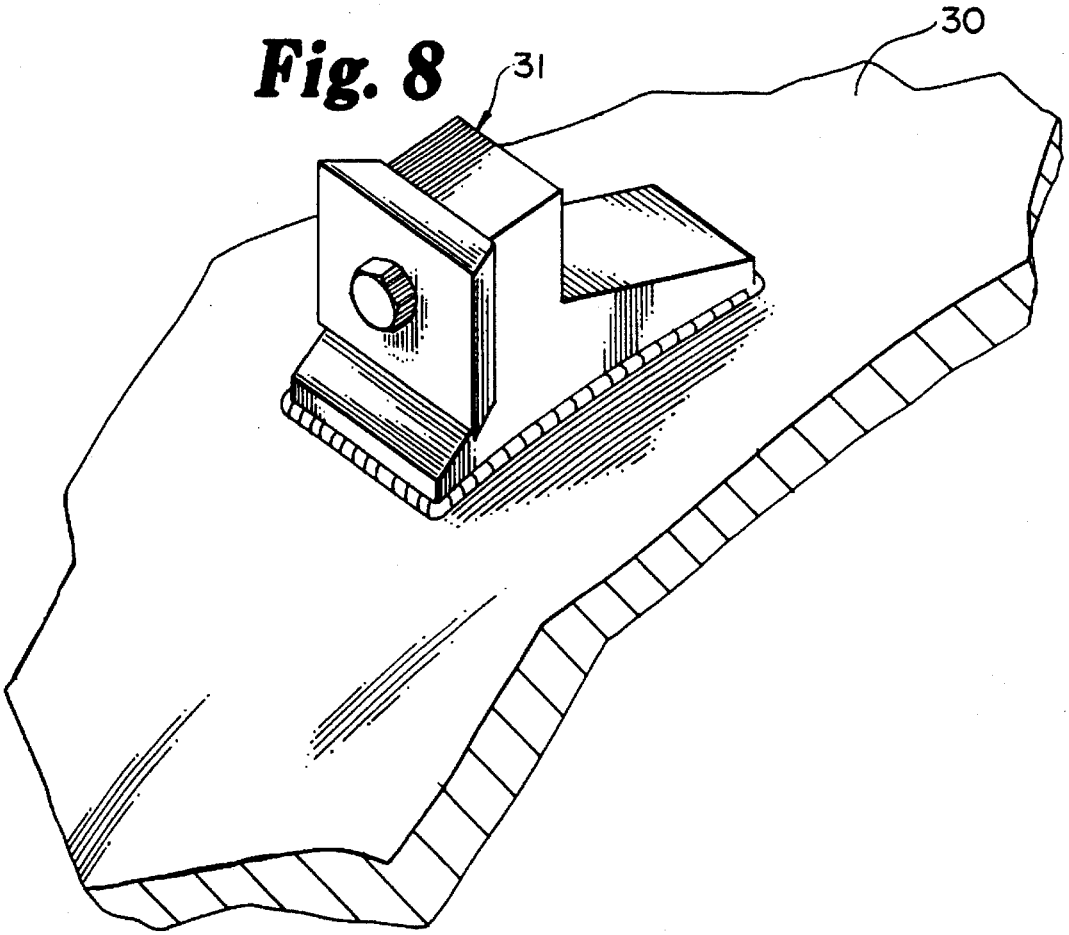
FIG. 8 is a fragmentary perspective view of a cutter to be used in my invention.
Figure 9:
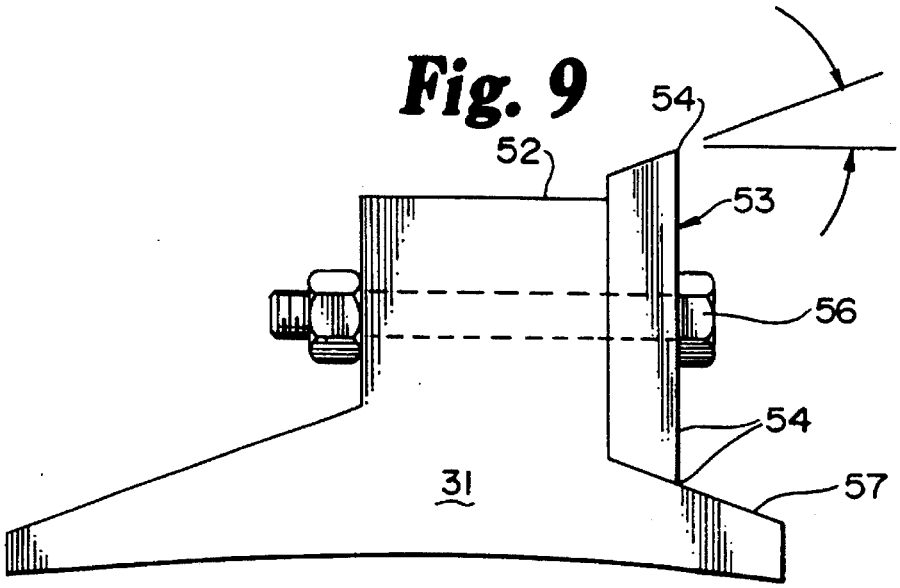
FIG. 9 is a right side elevational view of the cutter of FIG. 8.
Figure 10:
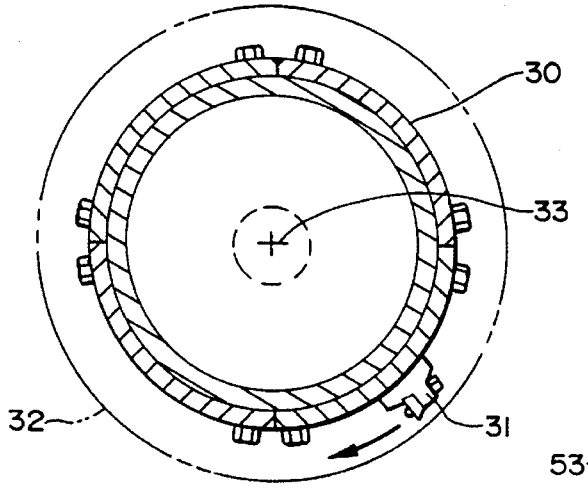
FIG. 10 is a sectional, mechanical diagram of a cutter drum assembly shown sectioned vertically transverse of the axis of rotation and illustrating a cutter mounted thereon.
Figure 11:
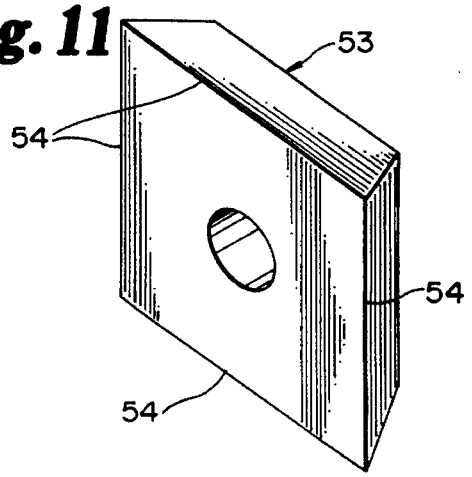
FIG. 11 is a perspective view of a bit which is removably disposed on my cutter.
Figure 12:
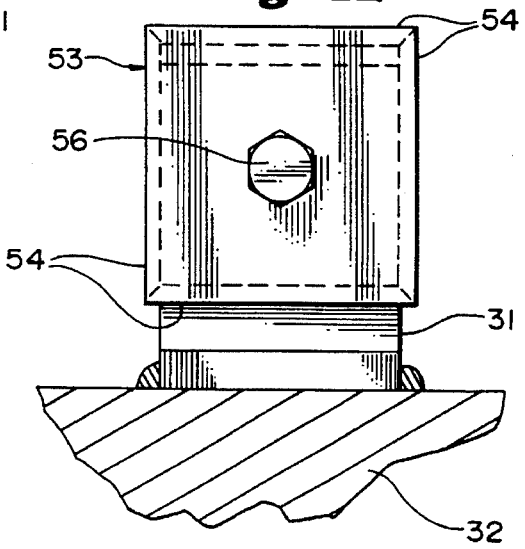
FIG. 12 is a fragmentary front elevational view of my cutter mounted on a drum.

FIGS. 6 and 7 illustrate an adjustable screen-concave 78 which includes a plurality of transversely extending screen members 79 having suitable apertures 81 so that the forward lower surface of screen-concave 78 presents an arcuate screen which terminates at its upper end in a breaker bar 82. Screen-concave 78 may be pivoted about a pivot pin 83 at its upper end through the action of hydraulic cylinder 84 and piston 85. Again, particulate materials that have been initially ground at the exit of hopper 10 may be carried completely around drum 30 and reintroduced into the grinding taking place at the front periphery of drum 30 adjacent to exit opening 11.

Figure 13:
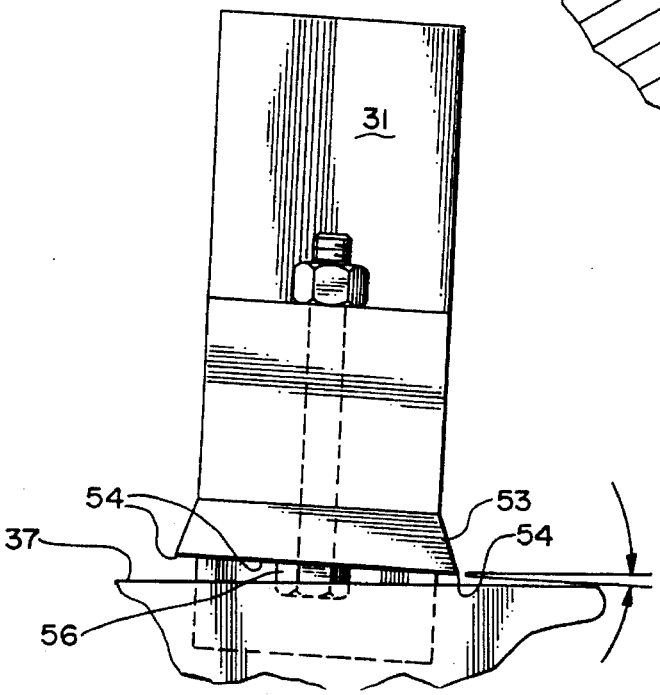
FIG. 13 is a top plan view thereof disposed on a fragment of a workpiece of FIG. 10.

Referring to FIGS. 8, 9, 10, 11, 12, and 13, a specific configuration of a cutter 31, such as may be mounted upon the segments of which drum 30 is comprised in a suitable pattern to provide an abrading surface 32 that is generated by the rotation of drum 30 about its axis 33. The number, spacing and relative locations of such cutters will be dependent upon the types of materials to be encountered as well as the speed of rotation of drum 30. Bit 31 is shown comprised of a mount-base 52 upon which is mounted a cutting bit 53 having a plurality of cutting edges 54 and a centrally-disposed aperture for receiving a bolt 56 that is utilized to clamp bit 53 to the front side of base 52 with one of the tapered side edges of bit 53 in registration with the tapered front portion 57 on base 52. Base 52 may be suitably attached to provide a specific angular relationship with the surface of drum 30 by suitable means, such as welding or the like. Bit 53 may be renewed by removing bolt 56 and turning bit 53 90° and reinstalling bolt 56. FIG. 13 shows a fragment of a breaker bar 37 in relation to bit 53.

While some of the illustrations show one side of my apparatus, one skilled in the art may reasonably be expected to understand that the opposite side is a substantial mirror image and that, for example, as shown in FIG. 2, the opposite sides of shroud 30 contain like operating equipment and shroud 30 is likewise dimensioned to provide an interior chamber that is sized to enclose rotating drum 30 and to receive the breaker bar and screen concave assemblies and elements so as to present a materials receiving and confining path whereby the desired comminuting action is attained. Further, the approximate angles of the elements of FIGS. 8–13 are shown in actual size and may be within a range that is appropriate for the materials of which the cutters are comprised and those which are to be ground to the desired particulate size.

OPERATION OF THE ILLUSTRATED EMBODIMENTS

In the basic operation of my invention, a drum 30 is provided with a plurality of cutter teeth 31 disposed in a suitable pattern commensurate with the materials to be ground and is caused to rotate at a predetermined speed, also commensurate with the characteristics of the materials to be ground. Breaker bar concave 36 is disposed adjacent the surface of revolution of the tips of cutters 31 on drum 30 so as to provide a coaction intermediate the breaker bars and the cutter bits to abrade, or cut the materials that may be introduced therebetween. As described above, drum 30 is disposed adjacent exit 11 in hopper 10. Hopper 10 is filled with a quantity of material to be ground and pistons 24 are caused to direct ram 20 toward exit 11 so that the materials will be directed into exit opening 11 and into engagement with the cylinder of revolution 32 of the cutter bits 31 disposed on drum 32 and the materials will be initially abraded or ground as they pass through exit opening 11 under the force exerted on ram 20. As the materials are ground, the particles, which may be large and small, appearing at the bottom of exit opening 11 come to engagement with cutter bar 37 which then coacts with the rotating drum teeth, and may then pass into a successive engagement with cutter bars 38 and 39, to then fall through the bottom of the chamber defined by shroud 34 onto a suitable conveyor (not shown).

As may be desired and as is shown on FIG. 3 of the drawings, a floor extending across concave 36 and intermediate breaker bars 37, 38 and 39 may be installed to assist in regulating the size of the ground particles so that by the time a particle is discharged from the rear end of concave 36, the size is substantially uniform as determined by the distance between the work surfaces or inner edges of breaker bars 37, 38 and 39 from the cylinder of revolution of cutter bits 31.

With regard to the illustration of FIG. 3, an accumulator 49 is shown connected to hydraulic line 50 which energizes cylinder 45 so that concave 36 may be displaced downwardly in the event a particularly hard or otherwise unbreakable material is encountered and, in this event, concave 36 will rotate in a counterclockwise direction about pivot pin 40 so as to permit the hard material to pass and then will be repositioned due to the forces supplied by hydraulic accumulator 43.

In the illustration of FIG. 2A, an hydraulic control system for actuating ram 20 through the application of hydraulic fluid under pressure to cylinder 23 connected to ram 20 through piston 24 is shown having a speed determination means 67 (consisting of a toothed gear) rotatably driven by prime mover engine 70 so that a plurality of pulses may be detected by suitable pulse detector 66 and applied to a controller 65 which is operable to generate a control signal for servo valve 62 which, in turn, is operable to control a suitable control valve 63 so as to vary the pressure of the fluid supplied to cylinder 23 from pump 61 through valve 64. When the load that may be imposed upon grinding drum 30 causes a reduction in speed of engine 70, the pressure exerted on ram 20 will be reduced and the drum will increase in speed to perform its grinding function.

In FIG. 4, a particulate screen 75 has been added to permit particles of less than a predetermined size to pass through and be discharged from my materials grinder. Any materials of a larger size will be recirculated internally of shroud 34 and may be further processed by one or more suitably positioned breaker bars, one of which is illustrated as breaker bar 76.

In the apparatus of FIG. 6, a screen concave 78 is shown to comprise a rear portion of shroud 34 that is open at the bottom and is mounted for rotation about a pin 83 extending from one side to the other of shroud 34 and is operable to be moved toward and from a position adjacent the lower rear side of drum 32 through a suitable cylinder 84 connected to piston 85. Again, a concave 36A extends laterally under drum 32 and is pivotable about pivot pin 40 so that its rear end may be moved up and down with respect to the bottom of drum 32. In the embodiment of FIG. 6, screen concave may be rotated to an inactive position and operation may continue as in the case of FIG. 1.

As may be seen from FIGS. 8–13 of the drawings, cutter bit 53 may be removed and rotated 90° and reinstalled to present fresh, sharp cutting edges for use in the grinding of the materials.

I claim:

1. A materials grinder comprising:

a hopper for receiving materials to be ground, said hopper including an open top, a horizontal floor and an exit opening adjacent said floor;

a ram in said hopper operable to displace materials on the floor of said hopper toward and through said exit opening;

a rotatable materials grinding drum adjacent said exit in said hopper, said drum having a surface including a plurality of abrading bits;

a concave adjacent said materials grinding drum mounted for rotation around an axis parallel to the axis of said grinding drum;

a cutter bar on said concave disposed below said exit opening and said drum in cooperating relationship with said abrading bits; and a displaceable support engaging and urging said concave toward said grinding drum and being displaceable to allow said concave to pivot away from said grinding drum when ungrindable material is encountered to allow the ungrindable material to pass between said cutter bar and said grinding drum.

2. A materials grinder as defined in claim 1 further including a plurality of intermediate breaker bars on said concave.

3. A materials grinder as defined in claim 1 wherein said concave is urged toward said materials grinding drum by means of a hydraulic cylinder.

4. A materials grinder as defined in claim 3 wherein said hydraulic cylinder is coupled to an accumulator that functions to restore said hydraulic cylinder to an undisplaced condition after said hydraulic cylinder is displaced by ungrindable material passing between said cutter bar and said materials grinding drum.

5. A materials grinder as defined in claim 1 wherein the force exerted by said ram increases when the speed of rotation of said materials grinding drum increases and wherein the force exerted by said ram decreases when the speed of rotation of said materials grinding drum decreases so as substantially to avoid operating said materials grinding drum in either an overloaded or underloaded condition.

6. A materials grinder comprising:

a hopper for receiving materials to be ground, said hopper including an open top, a horizontal floor and an exit opening adjacent said floor;

a ram in said hopper operable to displace materials on said floor of said hopper toward and through said exit opening;

a rotatable materials grinding drum adjacent said exit in said hopper, said drum having a surface including a plurality of abrading bits;

a concave adjacent said materials grinding drum mounted for rotation around an axis parallel to the axis of said grinding drum;

a cutter bar on said concave disposed below said exit opening and said drum in cooperating relationship with said abrading bits;

a hydraulic cylinder coupled to said concave so that pivoting movement of said concave displaces said hydraulic cylinder; and an accumulator coupled to said hydraulic cylinder for returning said hydraulic cylinder to its undisplaced condition;

said hydraulic cylinder and said accumulator thereby functioning to hold said concave adjacent said grinding drum while grindable materials are being ground and to swing away from said grinding drum when ungrindable materials are encountered to allow said ungrindable materials to pass between said concave and said grinding drum.

7. A materials grinder as defined in claim 6 further including a plurality of intermediate breaker bars on said concave.

8. A materials grinder as defined in claim 6 wherein the force exerted by said ram increases when the speed of rotation of said materials grinding drum increases and wherein the force exerted by said ram decreases when the speed of rotation of said materials grinding drum decreases so as substantially to avoid operating said materials grinding drum in either an overloaded or underloaded condition.

9. A materials grinder comprising:

a hopper for receiving materials to be ground, said hopper including an open top, a horizontal floor and an exit opening adjacent said floor;

a ram in said hopper operable to displace materials on said floor of said hopper toward and through said exit opening;

a rotatable materials grinding drum adjacent said exit in said hopper, said drum having a surface including a plurality of abrading bits;

a concave adjacent said materials grinding drum mounted for rotation around an axis parallel to the axis of said grinding drum;

a cutter bar on said concave disposed below said exit opening and said drum in cooperating relationship with said abrading bits;

a plurality of intermediate breaker bars on said concave;

a hydraulic cylinder coupled between said concave and a fixed anchor point so that pivoting movement of said concave away from said grinding drum compresses said hydraulic cylinder and so that extension of said hydraulic cylinder urges said concave toward said grinding drum;

an accumulator coupled to said hydraulic cylinder for receiving and accumulating hydraulic fluid discharged from said hydraulic cylinder when said hydraulic cylinder is compressed and for returning said hydraulic fluid to said hydraulic cylinder to extend said hydraulic cylinder when compressive forces on said hydraulic cylinder are released; and a hydraulic control system coupled to said ram and responsive to the speed of rotation of said grinding drum for increasing the force exerted on said ram when the speed of rotation of said grinding drum increases and for reducing the force exerted on said ram when the speed of rotation of said grinding drum decreases.

* * * * *